US009573040B1

(12) United States Patent
Metz et al.

(10) Patent No.: US 9,573,040 B1
(45) Date of Patent: Feb. 21, 2017

(54) SHORT GAME GOLF SWING TRAINING AID

(71) Applicants: Michael Metz, Simi Valley, CA (US); Anthony Martino, Simi Valley, CA (US)

(72) Inventors: Michael Metz, Simi Valley, CA (US); Anthony Martino, Simi Valley, CA (US)

( * ) Notice: Subject to any disclaimer, the term of this patent is extended or adjusted under 35 U.S.C. 154(b) by 0 days.

(21) Appl. No.: 15/143,913

(22) Filed: May 2, 2016

(51) Int. Cl.
*A63B 69/36* (2006.01)

(52) U.S. Cl.
CPC ..... *A63B 69/36* (2013.01)

(58) Field of Classification Search
USPC ..... 473/205, 213, 214, 223, 226, 227, 238, 473/257, 282, 275, 276, 277
See application file for complete search history.

(56) References Cited

U.S. PATENT DOCUMENTS 3,918,721 A * 11/1975 Trask, Jr. ..... A63B 69/3632 116/200
4,023,812 A 5/1977 Lorang
4,515,368 A 5/1985 Petitjean
5,074,564 A 12/1991 Rilling
5,180,169 A * 1/1993 Choy ..... A63B 69/0059 2/161.2
5,324,038 A * 6/1994 Sasser ..... A63B 24/0003 434/252
5,524,892 A 6/1996 Karp
5,772,523 A * 6/1998 Sheftic ..... A63B 69/3632 473/227
5,868,632 A * 2/1999 Drelick ..... A63B 69/3608 473/213
5,876,292 A * 3/1999 Hamilton ..... A63B 69/3608 273/DIG. 30
6,656,056 B1 * 12/2003 Leonard ..... A63B 57/00 473/212
7,857,705 B1 12/2010 Galloway
8,663,024 B2 3/2014 Kardos

OTHER PUBLICATIONS

Tour Striker Educator, web pages, www.tourstriker.com/shop/product_details.aspx?p=170, 9 pgs., Feb. 1, 2016.

* cited by examiner

*Primary Examiner* — Nini Legesse
(74) *Attorney, Agent, or Firm* — Karish & Bjorgum, PC

(57) ABSTRACT

A golf swing training apparatus to be used exclusively in the short game of golf to provide a first audible clicking sound when the golfer cocks his wrists and a second audible clicking sound when the golfer releases the club head. The training aid includes a base having a clamping mechanism for attaching the apparatus to the end of the grip of a golf club and a click generating mechanism including a spring having a free end which engages an actuator during the cocking of the wrist and flexes to generate the first audible click and again the second audible click when the flex of the spring relaxes during the release of the club head.

7 Claims, 6 Drawing Sheets

SHORT GAME GOLF SWING TRAINING AID

FIELD OF THE INVENTION

The field of the present invention relates generally to the game of golf and more specifically to a training aid which is useful primarily for the short game such as wedge and pitch shots from a distance of less than 100 yards into the green.

BACKGROUND OF THE INVENTION

It is very important for a golfer to perfect the golf swing in order to produce the proper flight and control of the golf ball. This is particularly true in the short game of golf, that is, the game where a golfer is executing a shot from 100 yards or less into the green. Statistics have indicated that approximately 75% of the game of golf is played as the short game. It is well known in executing a golf swing that the wrist cock of the golfer during the backswing sets the club at the proper position which is then to be held until the club is released at the time of impact of the club head with the golf ball. If the club head is not released at the proper time, then the execution of the golf shot is much less than what is desired by the golfer. It is recognized that there are many golf swing training aids in existence in the prior art, however, it is believed that the predominant number, if not all, of these golf swing training aids are directed to executing a full golf shot. There is, therefore, a need for a golf swing training aid that is exclusively directed to assisting the golfer in the short game.

SUMMARY OF THE INVENTION

A golf swing training aid for use exclusively in the short game to provide an audible click when the wrists are properly cocked and a second audible click when the club is properly released. The apparatus comprising a base having first and second compartments with the first compartment defining a housing for rotatably receiving an audible click generating mechanism and the second compartment defining a clamping mechanism for attaching the apparatus to the grip of a golf iron. The clamping mechanism is a generally cylindrical shaped member with a sloping sidewall conforming generally to the shape of a golf iron grip and has a pair of slots which allows a portion of the sidewall to be expanded and again retracted to secure the apparatus to the grip of the golf iron. The audible click generating mechanism is a spring housing having a leaf spring secured to a wall thereof with the spring having a free end extending outwardly toward a wall of the spring housing, a radially outwardly extending member is secured to the spring housing for rotating the housing along with the spring secured thereto as a user performs a golf swing and the user's arm contacts the outwardly extending member, an actuator is secured within the housing and extends to a position such that the free end of the spring contacts the actuator and produces a first audible click during the wrist cock by the user and then contacts the free end of the spring and produces the second audible click when the club head is released.

DETAILED DESCRIPTION OF THE PREFERRED EMBODIMENT

The present invention is a swing training aid which is used exclusively for the short game in the game of golf. The swing training aid is attachable to the grip of any wedge or other iron which is used by a golfer during execution of the short game. The device is slipped onto the grip end of the club and clamps onto the grip and includes an arm which extends laterally from the end of the golf club. The purpose of the aid is to provide an audible feedback to the golfer that enables the golfer to know whether he or she has properly executed the golf swing. This is accomplished by providing an audible click when the golfer sets the club in the backswing by cocking the wrists. Subsequently, when the golfer continues the golf swing by contacting the golf ball, it will provide a second audible click that will provide feedback to the golfer as to whether or not the golfer has properly executed the completion of the golf swing. If a second audible click occurs after impact, then this is an audible feedback to the golfer that he or she has properly executed the downswing. If, however, the audible click occurs before impact with the golf ball, it will also provide an audible feedback to the golfer that the release of the club was too soon and that, therefore, the downswing was improperly executed.

Figure 1:
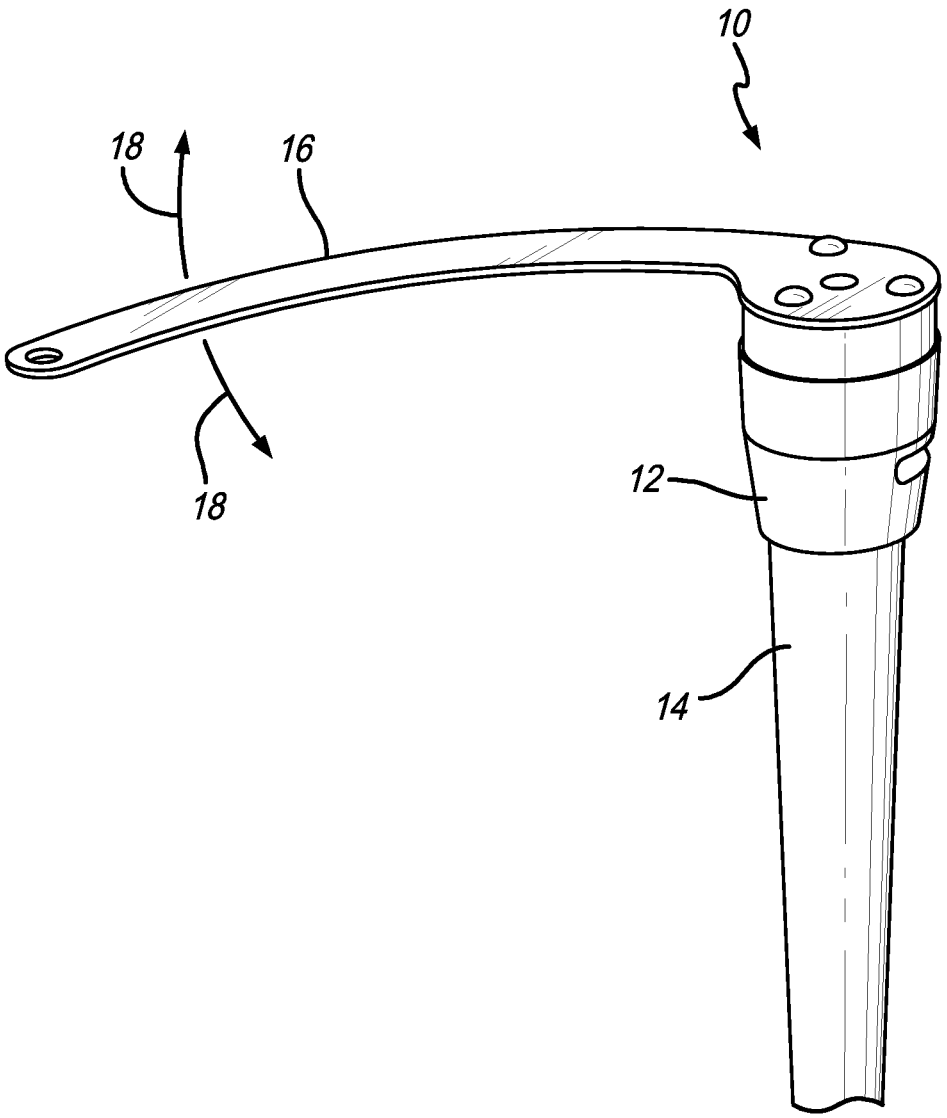
FIG. 1 is a perspective view taken from the side showing the golf training aid of the present invention affixed to the grip of a golf club.

Referring now more particularly to FIG. 1, there is shown the apparatus of the present invention attached to the grip of a wedge. As is therein shown, the device 10 includes a gripping mechanism 12 which grips the outer surface of the grip 14 which is attached to the wedge. There is provided an outwardly extending member 16 which will move in opposite directions as indicated by the arrow 18 during execution of the golf swing as will be more fully described hereinafter.

Figure 2:
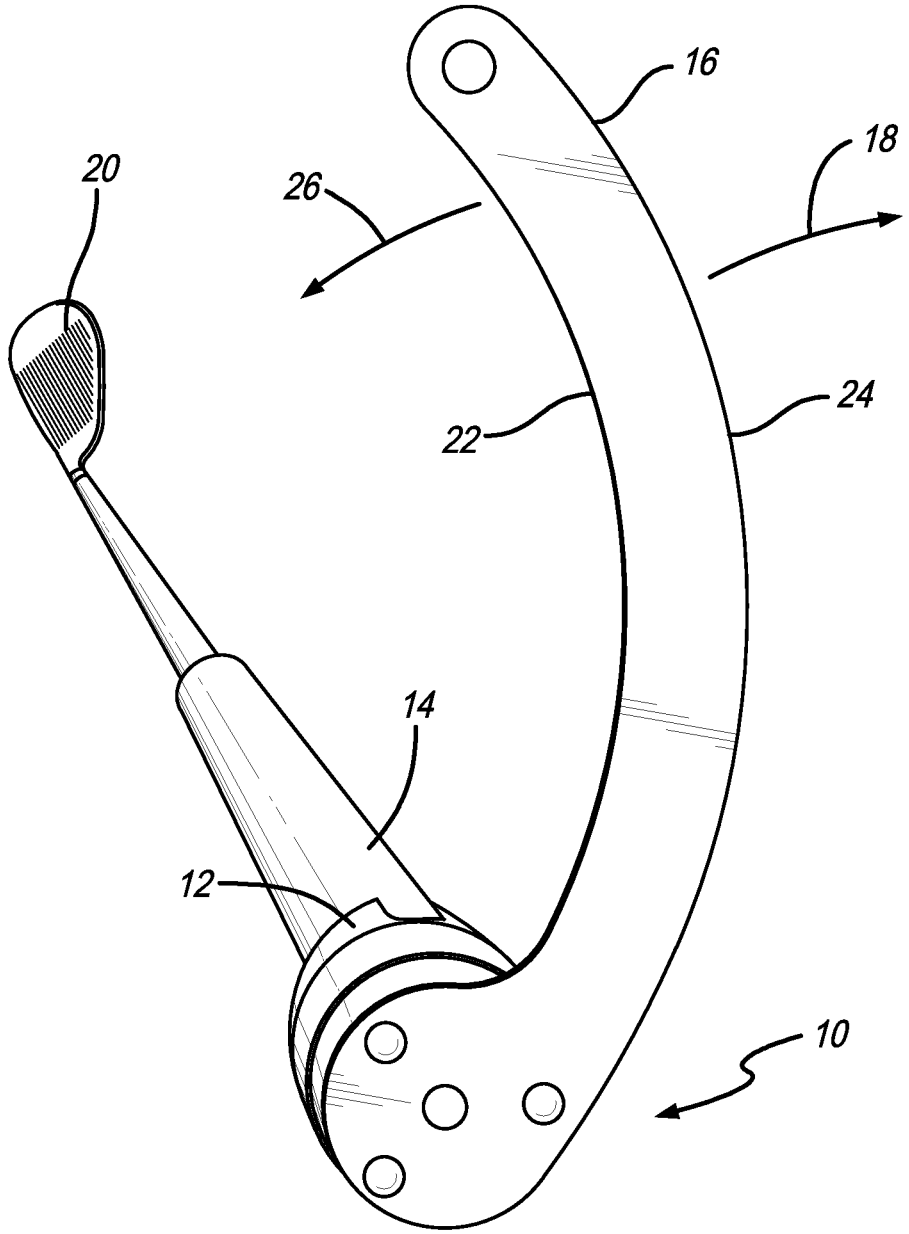
FIG. 2 is a perspective view taken from the top showing the golf training aid of the present invention properly aligned with a wedge.

By referring now to FIG. 2, the device 10 is shown attached to the grip 14 of the wedge 20 which is to be utilized by a right handed golfer. The outwardly extending member 16 is aligned so that it is generally in the same direction as the club head on the wedge 20 when the club head is positioned behind the ball which is to be struck by the golfer. As the golfer executes the swing of the wedge, the right handed golfer's left arm is in constant contact with the inner edge 22 of the outwardly extending member 16 on the backswing and will, as a result thereof, cause the member 16 to move in the direction shown by the arrow 18 when the wrists are cocked and when this occurs, an audible click will be heard by the golfer.

When the downswing occurs and the golfer rotates his or her arms, the outwardly extending member 16 will rotate in the opposite direction from that shown by the arrow 18 and such is indicated by the arrow 26. When such occurs, a second audible click is generated and, as above indicated, it will provide an audible feedback to the golfer as to whether or not the downswing has been properly executed. As above indicated if the second audible click occurs before impact of the club head on the wedge 20 with the golf ball, then the swing has not been executed properly. If, however, the click is heard immediately after impact, then the golf swing has been properly executed.

Figure 3:
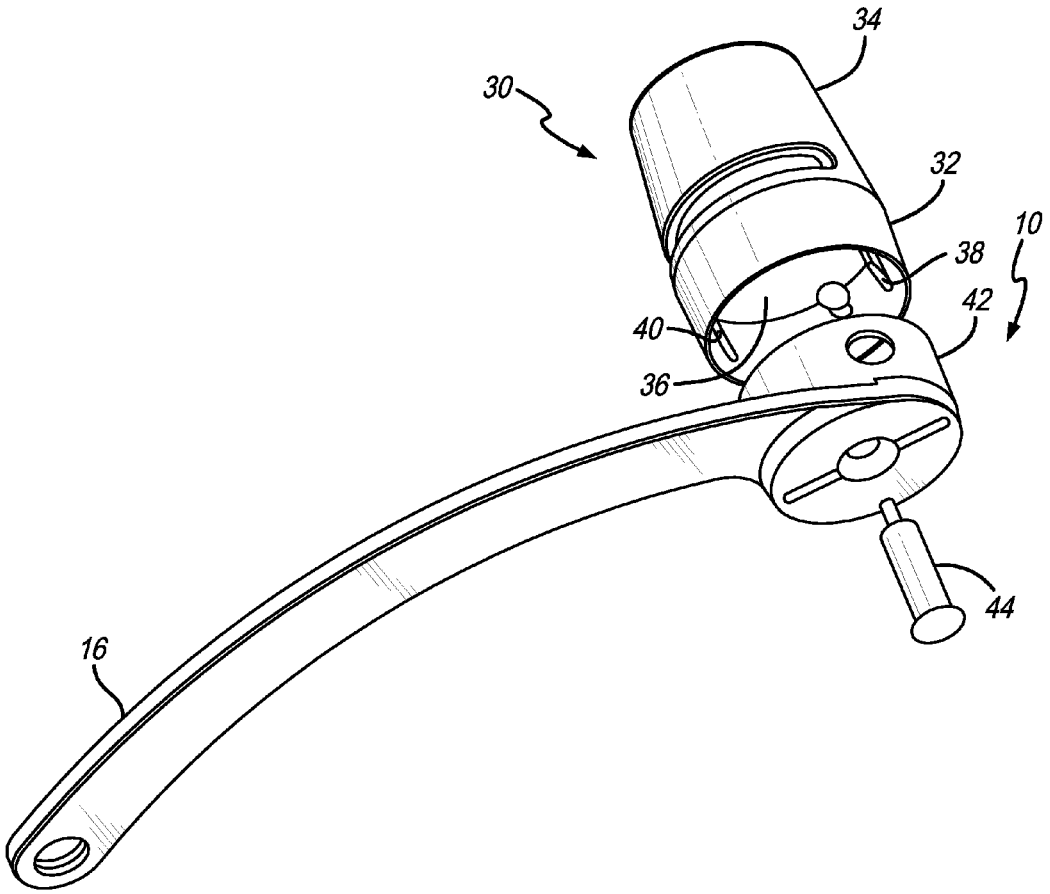
FIG. 3 is a perspective view partially in exploded format showing some elements of the golf training aid of the present invention.

Referring now more particularly to FIG. 3, the apparatus 10 constructed in accordance with the principles of the present invention is shown partially in an exploded view. As is therein shown a base member 30 has a first compartment 32 and a second compartment 34 which are separated by a wall 36 at a position where the two compartments join. An actuator 38 extends from the wall 36 outwardly and a backlash stop 40 also is secured to the wall 36 and extends outwardly therefrom. A spring housing 42 is secured to the outwardly extending member 16 and is rotatably secured by a pivot pin 44 to an opening (not shown) centrally located in the wall 36. As will be noted, the first compartment 32 thus defines a housing for rotatably receiving the spring housing 42 which in conjunction with the actuator 38 and a spring (to be described more fully below) is an audible click generating mechanism.

Figure 4:
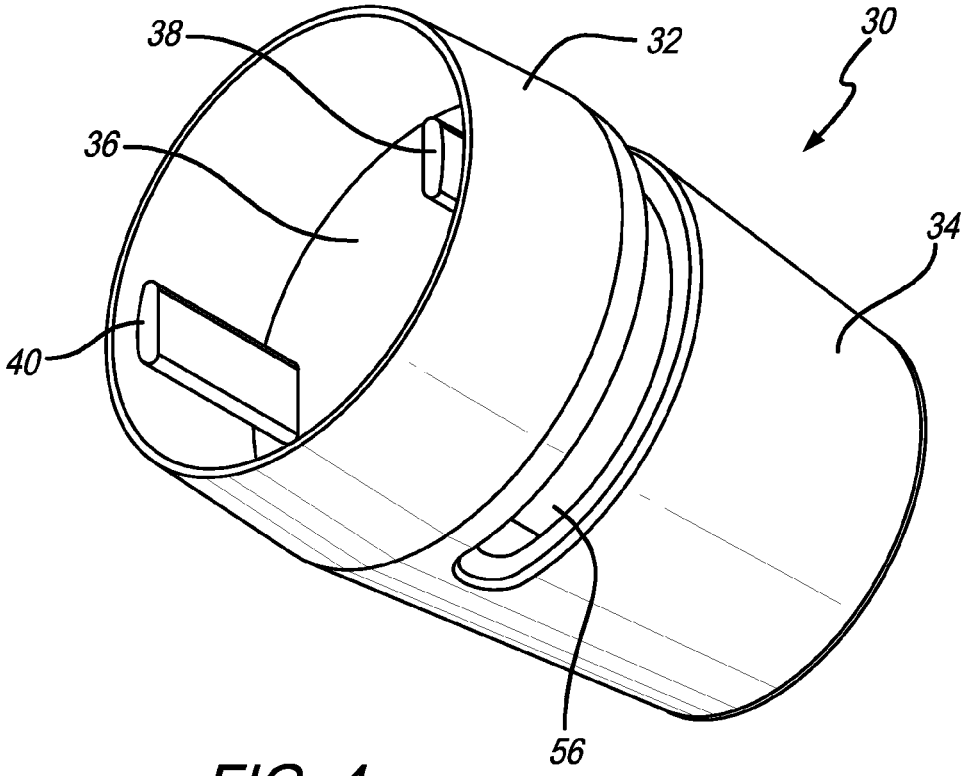
FIG. 4 is a perspective view of the base of the apparatus of the present invention.

Referring now more particularly to FIG. 4, the base 30 is illustrated in perspective view. As therein seen, the second compartment 36 defines a clamping mechanism in the general cylindrical form which as above referred to is utilized to secure the apparatus of the present invention to the end of the grip of a wedge. The wall 36, actuator 38 and stop 40 are more clearly shown.

Figure 5:
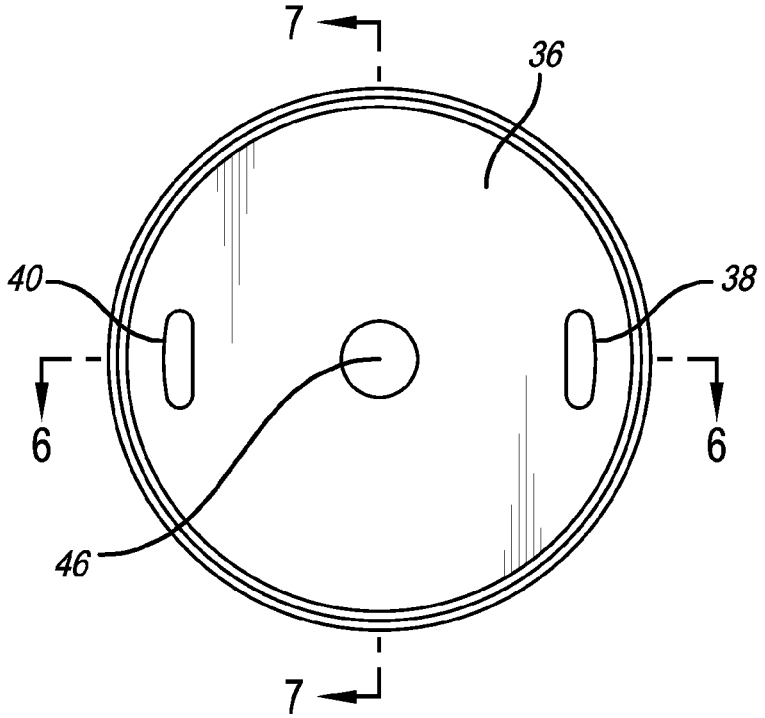
FIG. 5 is a bottom view of the base.

By referring to FIG. 5, there is illustrated the bottom view of the base 30 which shows the wall 36 with the actuator 38 and the stop 40. As is clearly shown in FIG. 5, the wall 36 includes a centrally-located opening which threadably receives the pivot pin 44 as shown in FIG. 3.

Figure 6:
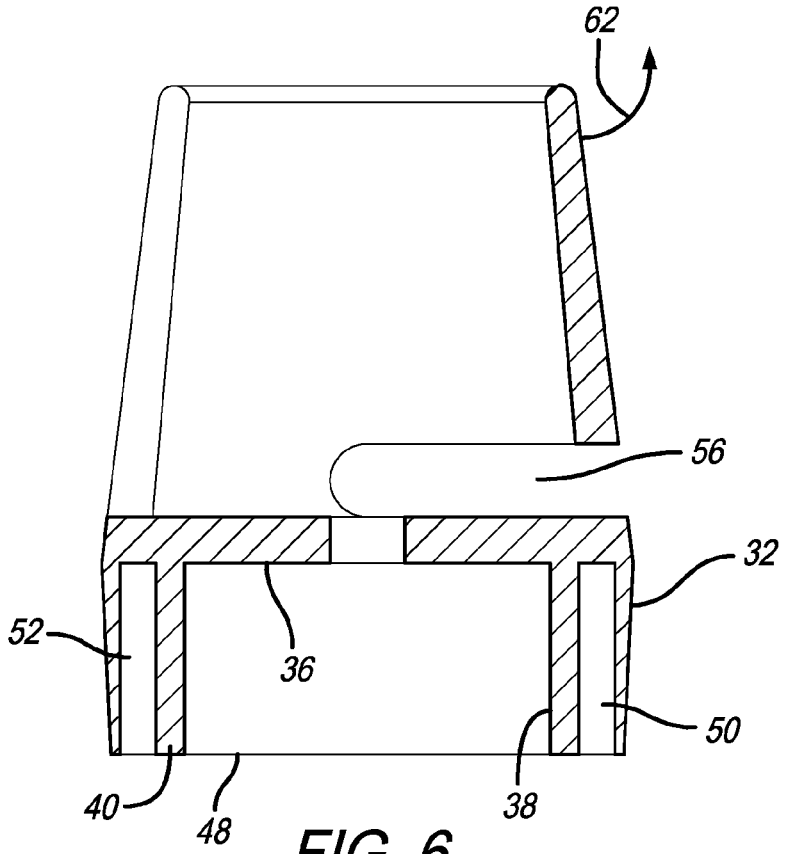
FIG. 6 is a cross-sectional view taken about the lines 6-6 of FIG. 5.

Referring now more specifically to FIG. 6, the base 30 is shown in cross section taken about lines 6-6 of FIG. 5. As is illustrated in FIG. 6, the actuator 38 and the stop 40 are formed as an integral part of the base 30 and extend outwardly from the wall 36 to the edge 48 of the first compartment 32. As should be noted, the actuator 38 and the stop 40 are spaced inwardly from the inner surface of the wall of the first compartment 32, thereby providing spaces 50 and 52. The spring housing which is also cylindrical in shape has an outer cylindrical wall which will fit into the spaces 50 and 52 as will be described more fully below.

Figure 7:
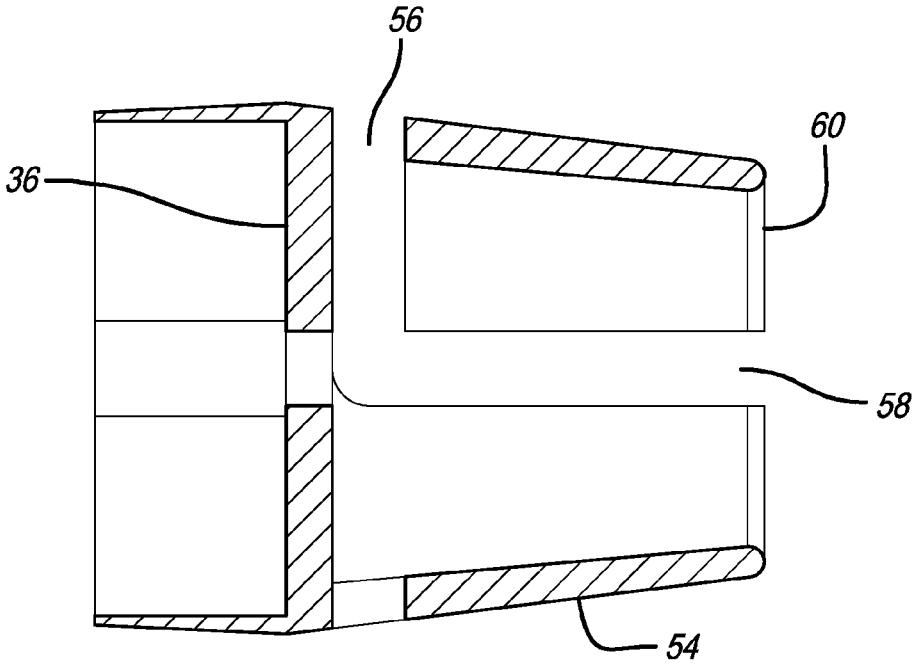
FIG. 7 is a cross-sectional view taken about the lines 7-7 of FIG. 5.

Referring now more particularly to FIG. 7, the second compartment 34 is shown generally cylindrical in form but with the wall 54 thereof tapering slightly inwardly which is to conform to the general configuration of the grip for the wedge to which the device will be attached. To provide the gripping or clamping mechanism, the wall 54 of the second compartment defines a circumferential slot 56 and also defines a longitudinal slot 58 which extends from the wall 36 to the terminus 60 of the cylindrical wall 54. By providing the slots 56 and 58, the wall 54 of the clamping mechanism can be rotated outwardly as shown by the arrow 62 in FIG. 6 to thereby allow the clamping mechanism to function by slipping the base onto the end of the grip of the wedge and once the wall 36 contacts the end of the grip of the wedge the wall 54 of the second compartment 34 is allowed to return to the position illustrated generally in FIGS. 4, 6 and 7, thereby clamping the apparatus of the present invention to the grip of the wedge.

Figure 8:
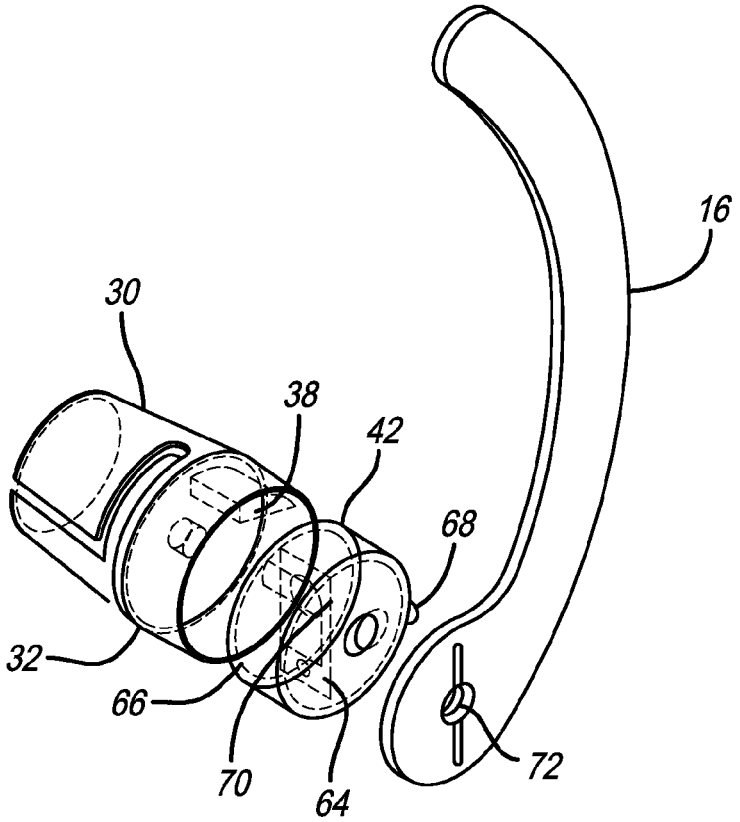
FIG. 8 is an exploded view showing the various components of the apparatus of the present invention in greater detail.

Referring now more particularly to FIG. 8, the apparatus of the present invention is shown in exploded view. As is therein illustrated, the spring housing 42 contains a spring 64 secured internally thereof. In accordance with one embodiment of the present invention, the spring 64 is secured to the cylindrical wall 66 of the spring housing on the internal surface thereof by a screw 68. It should be understood, however, by those skilled in the art that other means of attachment such as soldering, welding, fusion or the like may also be utilized to secure the spring internally to the internal surface of the spring housing 42. The spring includes a free end 70 thereof which extends outwardly and into a position generally adjacent the inner surface of the cylindrical wall 66 of the spring housing 42 such that it is adjacent the actuator 38 when the spring housing is inserted into the first compartment 32, to be received within the spaces 50 and 52 as illustrated and described in conjunction with FIG. 6 above. As is also described above, when the spring housing is thusly situated internally of the first compartment 32, the pivot pin 44 is inserted into the opening 72 in the outwardly extending member 16 through the spring housing into threaded engagement with the opening 46 provided in the wall 36 separating the first and second compartments 32 and 34. When the apparatus of the present invention is thus assembled and secured to the end of the wedge golf club, it will be permitted to function as above described to provide the audible clicks by way of feedback to the golfer.

Figure 9:
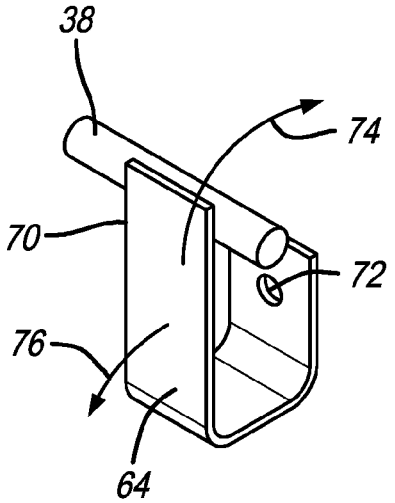
FIG. 9 is a schematic view illustrating the manner in which an audible click is generated by the apparatus of the present invention during execution of the golf swing.

Referring now more specifically to FIG. 9, there is illustrated schematically the manner in which the audible click is generated as the golfer executes the short game by cocking the wrists and then releasing the club. As is shown in FIG. 9, the spring 64 end 70 is in contact with the actuator 38. Since the spring 64 is secured to the spring housing 42 by the screw 68 which passes through the opening 72 in the spring 64 and since the spring housing is affixed to the outwardly extending member 16, the spring housing will rotate in a generally clockwise direction as shown by the arrow 74 when the golfer cocks his or her wrists during the backswing. As the spring housing rotates, the spring 64 flexes and as it does so, it will provide a click which is the audible clicking sound feedback to the golfer during the wrist cock. When the golfer then executes the downswing and releases the club head, the spring housing will rotate in the opposite direction as shown by the arrow 76 and when it does so, the pressure on the spring relaxes and this causes a second audible click to be generated as a feedback to the golfer that the club has been released. As above referred to, the timing of the audible click feedback to the golfer is demonstrative to the golfer as to whether or not the release of the club has been executed properly. If the audible feedback click occurs prior to impact of the club head with the golf ball, then the release of the club has been too early and the execution of the downswing has been improperly executed. If, however, the audible feedback click occurs immediately after impact, the release of the club has been properly executed and the golfer then knows that he or she has properly executed the downswing and the release of the golf club.

There has been thus disclosed a golf training aid which is used exclusively to assist the golfer in executing the short game particularly those shots such as wedge shots or pitch shots which are within 100 yards or thereabouts of the green as the golfer plays the game of golf.

What is claimed is:

1. A golf swing training apparatus for use exclusively in a short game of golf to provide an audible click when a golfer's wrists are cocked and an audible click when a club is released comprising:

A. a base having first and second compartments, said first compartment defining a housing for rotatably receiving an audible click generating mechanism, said second compartment defining a clamping mechanism for attaching said apparatus to the grip of a golf iron;

B. said clamping mechanism being generally cylindrical with a sloping sidewall conforming to the shape of a golf iron grip and defining a circumferential slot disposed adjacent the area where said first and second compartments join each other and a longitudinal slot extending from said area where said first and second compartments join each other to a terminus of said cylindrical sidewall to allow the sidewall of said cylinder to be opened to receive the grip of a golf iron and then returned to its original position to clamp the apparatus on the golf iron grip;

C. said audible click generating mechanism comprising a spring housing, a leaf spring secured to the inner surface of a wall of said spring housing and having a free end extending outwardly toward a wall of said spring housing, a radially outwardly extending member secured to said spring housing for rotating said spring housing within said housing as a user performs a golf swing and the user's arm contacts the outwardly extending member; and D. an actuator secured within said housing and extending to a position such that the free end of said spring contacts said actuator and produces a first audible click during the wrist cock by the user and then the free end of the spring again contacts the actuator and produces a second audible click when said club head is released.

2. The apparatus as defined in claim 1 wherein said first audible click is generated by the flexing of said spring when said spring housing is rotated in a first direction and said second audible click is generated by said spring when said flex of said spring is released when said spring housing is rotated in a second direction opposite to said first direction.

3. The apparatus as defined in claim 2 further including a stop member secured within said housing and extending into a cavity defined by said spring housing to limit travel of said actuator to prevent damage to said leaf spring.

4. The apparatus as defined in claim 1 which further includes a wall in said base separating said first and second compartments, said wall defining a centrally disposed bore therethrough.

5. The apparatus as defined in claim 4 which further includes a pivot pin secured to said base in said wall and extending through said radially outwardly extending member and said spring housing to rotatably secure said spring housing within said first compartment of said base.

6. The apparatus as defined in claim 4 wherein said actuator is secured to said wall.

7. The apparatus as defined in claim 4 which further includes a backlash stop member secured to said wall and extending into said spring housing to prevent undesired rotation of said spring housing thereby preventing damage to said spring.

* * * * *